US008469757B2

(12) United States Patent
Luke et al.

(10) Patent No.: US 8,469,757 B2
(45) Date of Patent: Jun. 25, 2013

(54) MODULAR FIN FOR A SURFBOARD, SAILBOARD OR OTHER WATER-BORNE DEVICE

(75) Inventors: William A. Luke, Santa Cruz, CA (US); Robert A. Hines, Santa Cruz, CA (US); Leslie Segal Purcell, Carrboro, NC (US); Stephen Scott Purcell, Carrboro, NC (US)

(73) Assignee: Fin & Fin Surf Board Fin Company, Santa Cruz, CA (US)

( * ) Notice: Subject to any disclaimer, the term of this patent is extended or adjusted under 35 U.S.C. 154(b) by 1020 days.

(21) Appl. No.: 12/136,550

(22) Filed: Jun. 10, 2008

(65) Prior Publication Data

US 2008/0311807 A1 Dec. 18, 2008

Related U.S. Application Data

(60) Provisional application No. 60/934,608, filed on Jun. 13, 2007.

(51) Int. Cl.
*B63B 1/00* (2006.01)

(52) U.S. Cl.
USPC ..... 441/79

(58) Field of Classification Search
USPC ..... 441/79, 74
See application file for complete search history.

(56) References Cited

U.S. PATENT DOCUMENTS

| | | | | |
|---|---|---|---|---|
| 3,422,471 | A | 1/1969 | Morey et al. | 9/310 |
| 3,579,681 | A | 5/1971 | Pope, III et al. | 9/310 |
| 3,659,300 | A | 5/1972 | Johnson | 9/310 E |
| 3,747,138 | A | 7/1973 | Morgan | 9/310 |
| 4,398,485 | A | 8/1983 | Diziere | 114/132 |
| 4,680,949 | A | 7/1987 | Stewart | 70/14 |
| 4,730,568 | A | 3/1988 | Campbell | 114/39.2 |
| 4,904,215 | A * | 2/1990 | Sherwood | 441/79 |
| 5,176,553 | A | 1/1993 | Tuttle | 441/79 |
| 5,215,488 | A | 6/1993 | Bailey | 441/79 |
| 5,934,962 | A * | 8/1999 | Daum et al. | 441/79 |
| 6,000,979 | A | 12/1999 | Stewart | 441/75 |
| 6,702,634 | B2 | 3/2004 | Jung | 441/74 |
| 6,752,674 | B2 | 6/2004 | Jolly | 441/79 |
| 2005/0064775 | A1 * | 3/2005 | White | 441/79 |
| 2007/0202760 | A1 * | 8/2007 | Caldwell et al. | 441/79 |

FOREIGN PATENT DOCUMENTS

| | | |
|---|---|---|
| EP | 0079113 | 5/1983 |
| FR | 2 659 931 | 9/1991 |
| WO | WO 02/47971 | 6/2002 |

OTHER PUBLICATIONS

U.S. Appl. No. 09/946,916, filed Aug. 4, 2001.
U.S. Appl. No. 08/896,489, filed Jul. 18, 1997.
International Search Report and Written Opinion from PCT Application No. PCT/US2008/007272 mailed on Sep. 9, 2008.

* cited by examiner

*Primary Examiner* — Edwin Swinehart
(74) *Attorney, Agent, or Firm* — Zilka-Kotab, PC

(57) ABSTRACT

A fin in one embodiment includes a fin box assembly including a fin box adapted for coupling to a body portion of a water-borne device, and a fin assembly having a base member that is releasably engagable in said fin box. A fin assembly according to one embodiment includes a base member adapted for releasable engagement in a fin box that is coupled to a water-borne device, and a fin member coupled to said base member. A water-borne device in one embodiment includes a body portion, and a fin box assembly coupled to the body portion, the fin box assembly including a fin box adapted for receiving a fin assembly having a base member that is releasably engagable in said fin box.

15 Claims, 8 Drawing Sheets

MODULAR FIN FOR A SURFBOARD, SAILBOARD OR OTHER WATER-BORNE DEVICE

RELATED APPLICATIONS

This application claims priority to U.S. Provisional Patent Application No. 60/934,608, filed Jun. 13, 2007, which is herein incorporated by reference.

FIELD OF THE INVENTION

The present invention relates generally to fins for surfboards, sailboards and the like, and more particularly to adjustable and/or replaceable and/or removable fins.

SUMMARY OF THE INVENTION

A fin in one embodiment includes a fin box assembly including a fin box adapted for coupling to a body portion of a water-borne device, and a fin assembly having a base member that is releasably engagable in said fin box.

The fin assembly may further include a fin member fixedly coupled to said base member. The fin assembly may further include a fin member detachably coupled to said base member. The base member may include protrusions that engage a depression in the fin box, e.g., flange members that engage a groove in the fin box.

In one approach, the base member includes multiple leg portions defined in part by slots positioned therebetween, the leg portions engaging the fin box. The fin box may include ribs extending outwardly therefrom. The fin box assembly may include a base, the fin box being coupled to the base.

The fin assembly may include a tether engagement portion. The fin box may also or alternatively include a second tether engagement portion.

A fin assembly according to one embodiment includes a base member adapted for releasable engagement in a fin box that is coupled to a water-borne device, and a fin member coupled to said base member.

The fin member may be fixedly coupled to said base member, or may be detachably coupled to said base member.

A water-borne device in one embodiment includes a body portion, and a fin box assembly coupled to the body portion, the fin box assembly including a fin box adapted for receiving a fin assembly having a base member that is releasably engagable in said fin box.

In one embodiment, in combination with the body portion and the fin box, a fin assembly is provided with a base member that is releasably engagable in said fin box. In one approach, the base member includes protrusions that engage a depression in the fin box. In another approach, the base member includes multiple leg portions defined in part by slots positioned therebetween, the leg portions engaging the fin box. In a further approach, the fin assembly includes a tether engagement portion.

The fin box may include ribs extending outwardly therefrom. The fin box assembly may include a base mounted to the body portion, the fin box being coupled to the base.

Illustrative water-borne devices include, but are not limited to, surfboards, sailboards, motorized devices, etc.

Other aspects and embodiments of the present invention will become apparent from the following detailed description, which, when taken in conjunction with the drawings, illustrate by way of example the principles of the invention.

IN THE DRAWINGS

DESCRIPTION OF THE PREFERRED EMBODIMENTS

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

A fin in one general embodiment includes a fin box assembly including a fin box adapted for coupling to a body portion of a water-borne device; and a fin assembly having a base member that is releasably engagable in said fin box.

A fin assembly in another general embodiment includes a base member adapted for releasable engagement in a fin box that is coupled to a water-borne device; and a fin member coupled to said base member.

A water-borne device in one general embodiment includes a body portion; and a fin box assembly coupled to the body portion, the fin box assembly including a fin box adapted for receiving a fin assembly having a base member that is releasably engagable in said fin box.

In any of the embodiments, known materials may be used to make any of the various parts and components. In some instances, the description sets forth illustrative materials that may be used. It should be kept in mind that this is done by way of example only and in no way is meant to be limiting.

Figure 1:
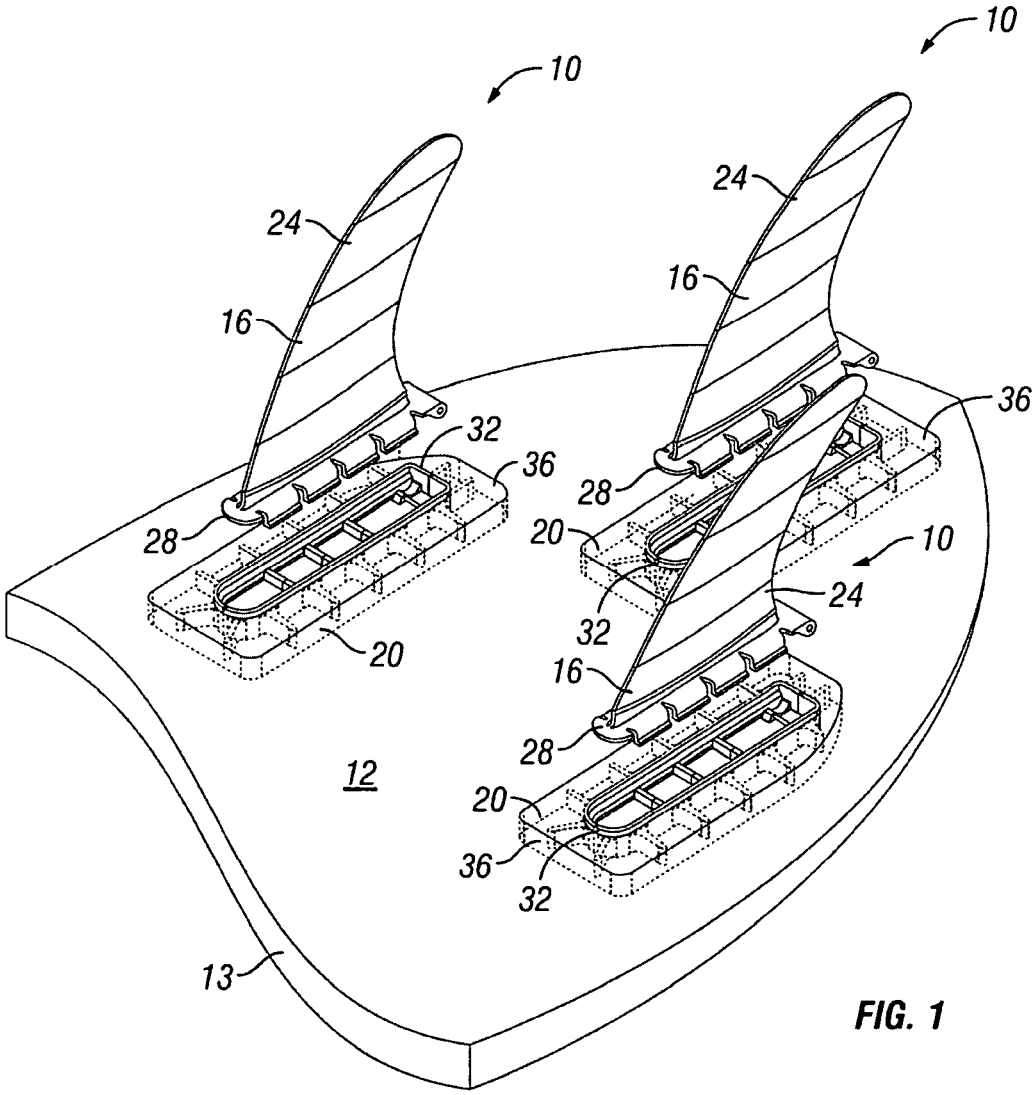
FIG. 1 is a perspective view including assembly drawings of three fin devices according to one embodiment of the present invention.

FIG. 1 is a perspective view of a rearward portion of a water-borne device, in this example, a surfboard 12 or similar device, and having three fins 10 disposed thereon (e.g., coupled to a body portion 13 of the water-borne device), where the three fins are depicted in assembly drawing style. As depicted therein, each fin 10 includes a fin assembly 16 and a fin box assembly 20. The fin assembly 16 includes a base member 28 and, in some embodiments, a fin member 24. The fin box assembly 20 includes a fin box 32 and, in some embodiments, a base 36, the base 36 being typically comprised of a foam, rubber, polymeric, or other lightweight, medium to high strength material, into which the periphery of the fin box 32 has been encased. For the present description, the base 36 will be described as a foam base, foam being the preferred material, though other materials such as plastics, resins, etc. may be used. A typical surfboard 12 or the like may have one or more fins 10, three being shown in FIG. 1. A more detailed depiction of the components of various embodiments of the present invention is next presented.

Figure 2:
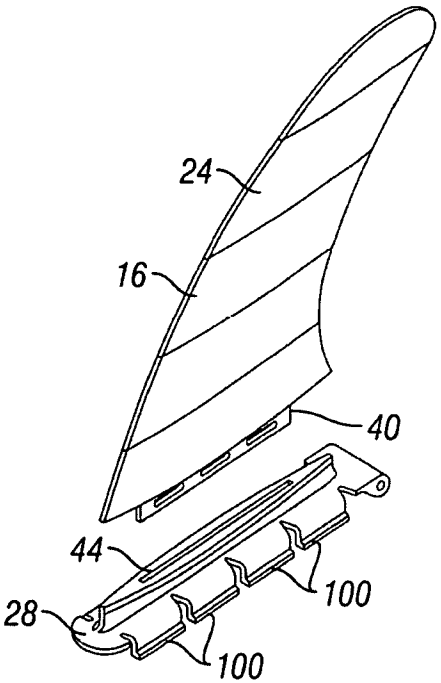
FIG. 2 is an assembly drawing of a fin and base member of the fin assembly according to one embodiment of the present invention.

FIG. 2 is an assembly drawing of a fin assembly 16 according to one embodiment of the present invention including the fin member 24 and the base member 28. The fin member 24 may include a base engagement mechanism 40, such as the projecting slotted flanges 40 depicted in FIG. 2, and the base member may include a corresponding fin engagement mechanism 44, such as a slot formed in the upper surface of the base member for mating engagement with the flanges 40.

In one fin engagement embodiment, the fin member 24 may be inserted into a base mold and the base member 28 may thereafter be molded such that portions of the base member 28 are overmolded with the fin member 24 to permanently hold the fin member 24 and base member 27 together. In another approach, the fin member 24 may be formed around the base member 28. In yet another approach, the fin member 24 and base member 28 may be concurrently formed, of the same or different materials.

In alternative embodiments, the base member 28 may be formed with a releasable fin engagement mechanism such that a fin member 24 may be releasably engaged with the base member. In this embodiment, differing fins from differing fin manufacturers can be engaged with a base member 28 by adapting the fin engagement mechanism of the base member to matingly engage the various fin members of various manufacturers. Many types of locking mechanisms can be used, including known mechanism for detachably coupling two parts together.

Illustrative materials from which the fin member 24 may be formed include fiberglass, resins, plastics, etc. Illustrative materials from which the base member 28 may be formed are set forth below.

Figure 3:
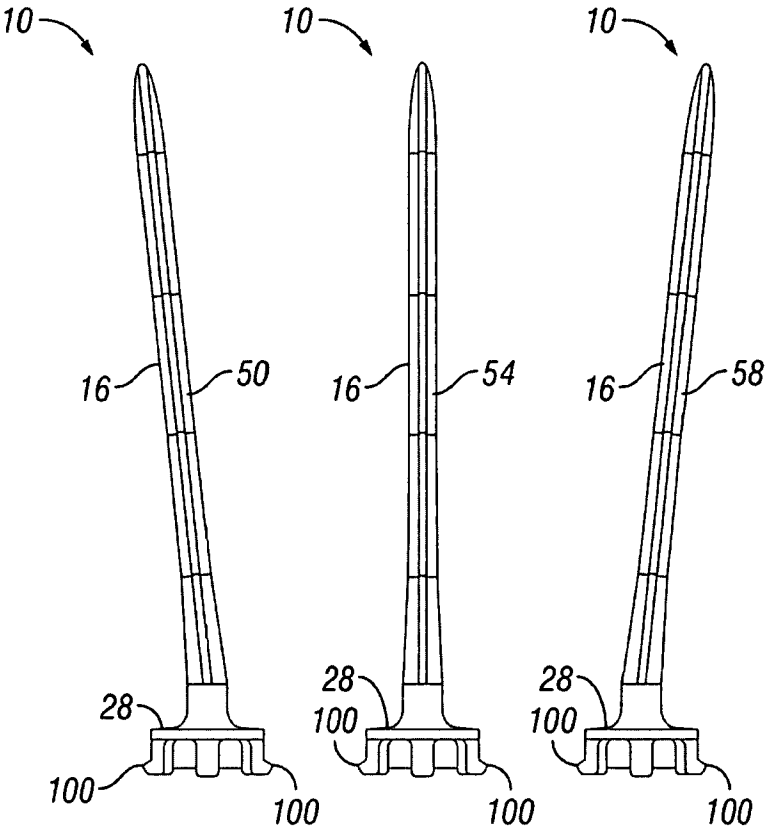
FIG. 3 is a front view of the fin assembly according to one embodiment of the present invention.

FIG. 3 is an elevational view of three fins 10 according to one embodiment of the present invention that are suited for use with a surfboard or the like. Particularly, FIG. 3 depicts a right fin assembly 50, a center fin assembly 54 and a left fin assembly 58. It can be seen that the right fin assembly and left fin assembly are formed such that the fins diverge from a vertical center line of the base member, whereas the center fin projects vertically from the base member. Such a fin orientation is well known to those skilled in the art as it provides increased control and stability to a surfboard or the like.

The teachings herein are applicable to all types of fin arrangements, including single-fin embodiments, dual-fin embodiments, four-fin embodiments, five-fin embodiments, etc.

Figure 4:
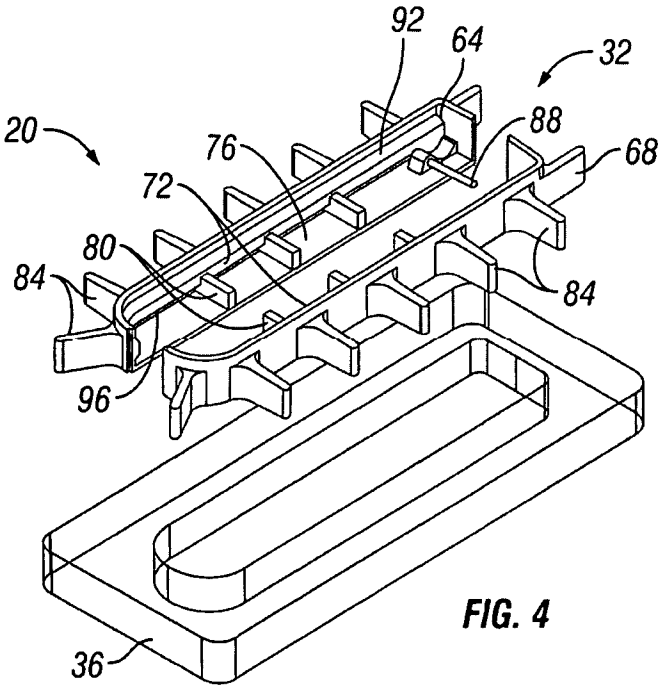
FIG. 4 is a perspective assembly drawing of a fin box assembly according to one embodiment of the present invention.

FIG. 4 is a perspective assembly drawing of the fin box assembly 20 according to one embodiment of the present invention. As depicted therein, the fin box assembly includes a fin box 32 that may be comprised of a single piece, or as shown, multiple separately molded pieces 64 and 68 that are joined together such as by ultrasonic welding, adhesive, mechanical coupling, etc. The fin box 32 includes two side walls 72 and a base surface 76; a plurality of fin box strengthening ribs 80 may be formed to project from the side walls within the box, and a plurality of laterally extending ribs 84 are preferably formed to engage the foam base 36 into which the fin box may be mounted.

The fin box may include a depression within which protrusions of the base member engage to effect a detachable coupling of the base member to the fin box. A preferred embodiment of the fin box includes an inwardly projecting ridge 92 that is formed along the inner surface of the side walls 72. As is described in greater detail below, the inwardly projecting ridge 92 forms an undercut slot 96 (depression) into which a projecting flange member 100 (protrusion) of the base member 28 of the fin assembly is designed to reside, to releasably hold the base member of the fin assembly in the fin box, all as is further described below.

The fin box may also include a tether engagement portion 88 such as a tether pin, loop, hole, etc. for the engagement of a fin tether (not shown) therewith. A fin tether, such as a rope, string, ribbon, etc., may be used to couple the fin assembly to the fin box or surfboard to keep the fin assembly nearby in case of detachment.

Figure 5:
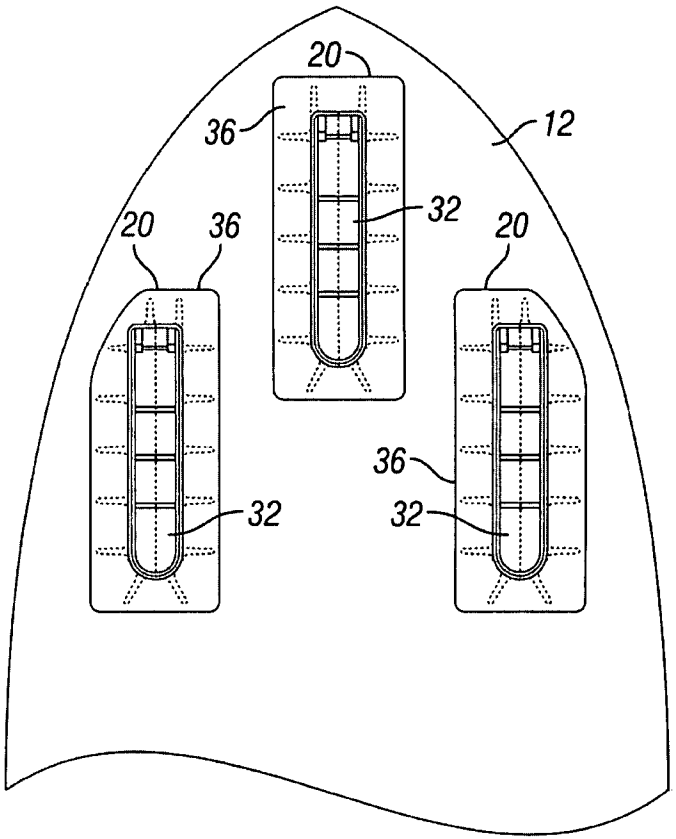
FIG. 5 is a top plan view of three fin box assemblies disposed within a surf board or the like according to one embodiment of the present invention.

FIG. 5 is a top plan view of a portion of a surfboard 12 or the like having three fin box assemblies 20 disposed therein. As can be seen in FIG. 5, each fin box 32 (left, center and right) has been molded into a foam base 36, or the foam base 36 has been molded around the fin box 32, to create a fin box assembly 20. Thereafter, each fin box assembly is inserted into a surfboard or the like during fabrication thereof, such that the completed surfboard includes the fin box assemblies therein. In one preferred approach, the core of the surfboard or the like is formed, e.g., of a high strength foam. Openings are formed in the core, e.g., using a router, saw, etc. and the fin box assembly is inserted in the openings. An adhesive, a mechanical coupling, etc. may be used to couple the fin box assembly to the core. Then, a hard outer coating, e.g., of fiberglass, resin, etc. may be formed over the core and periphery of the fin box assembly. In another approach, the fin box assembly is added to the surfboard or the like after the hard outer coating is already formed thereon. In a further approach, the fin box assembly includes only the fin box, around which the core is molded directly. In yet another approach, the surfboard does not have a hard outer coating, e.g., as in a wooden surfboard. In such case, the fin box assembly may be added to the surfboard.

Figure 6:
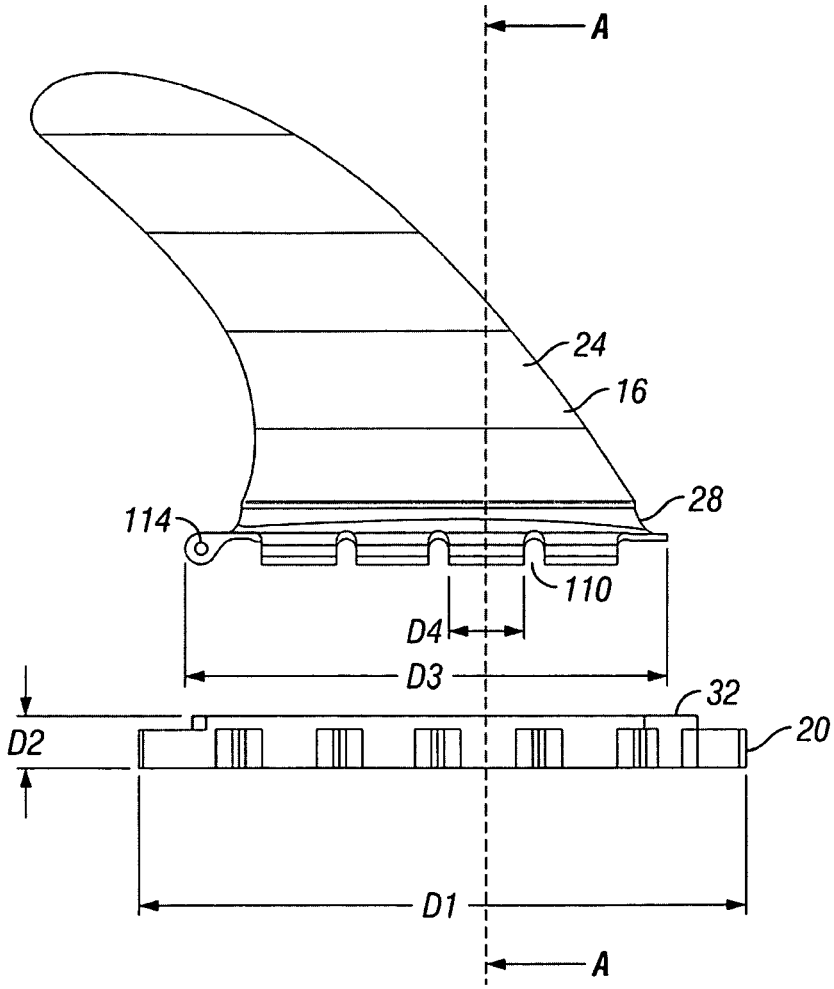
FIG. 6 is an assembly drawing depicting a side elevational view of the fin, base member and fin box according to one embodiment of the present invention.
Figure 7:
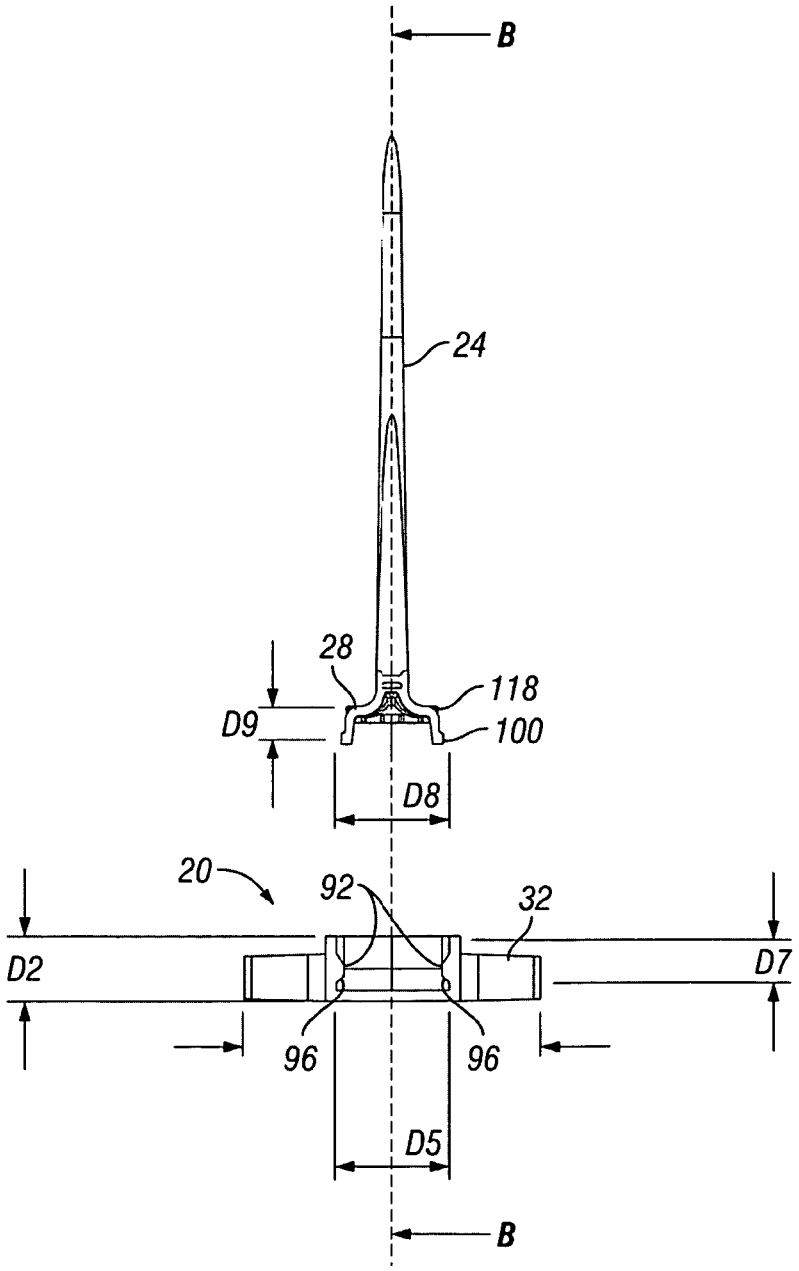
FIG. 7 is a cross-sectional view of the assembly drawing of FIG. 6, taken along lines A-A of FIG. 6.
Figure 8:
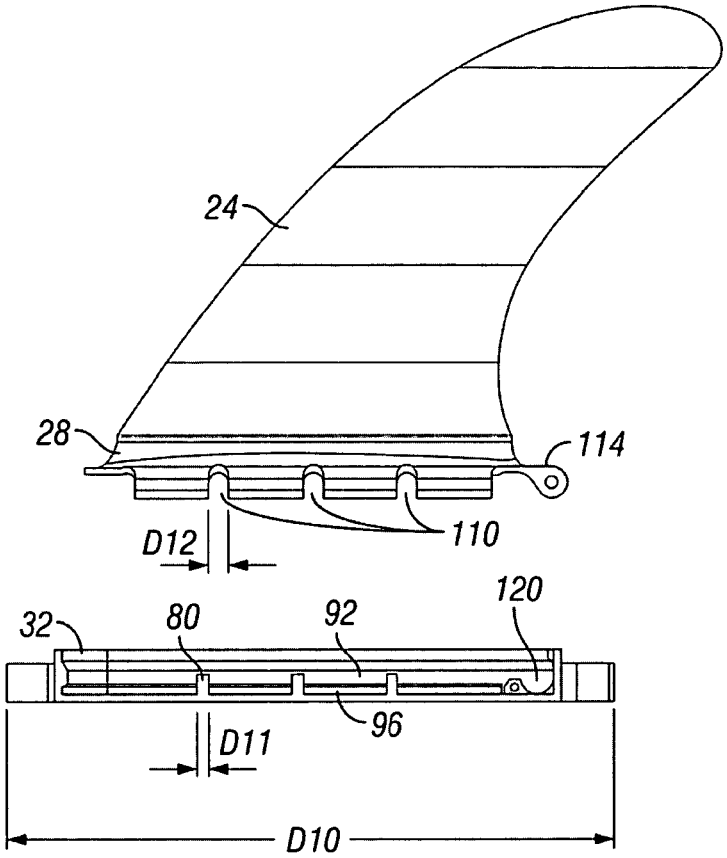
FIG. 8 is a cross-sectional view of the assembly drawing depicted in FIG. 6, taken long lines B-B of FIG. 7.

FIGS. 6, 7 and 8 depict detailed assembly drawings of the fin assembly 16 with the base member 20, wherein FIG. 6 is a side elevational view, FIG. 7 is a cross-sectional view taken along lines A-A of FIG. 6 and FIG. 8 is a cross-sectional view taken along lines B-B of FIG. 7. With regard to FIG. 6, it is seen that the fin member 24 is engaged within the base member 28. As stated above, the fin member may be overmolded with the base member or alternatively, the fin member may be releasably engagable with the base member. As can be seen in FIG. 6, the base member 28 may include a plurality of slots 110 that are laterally formed therethrough for the projection of the fin box strengthening ribs 84 therein. The base member may also include a tether engagement portion 114 for the attachment of a fin tether thereto, where the fin tether may engage the tether engagement portion 88 of fin box assembly, a tether engagement portion on the surfboard or the like, etc.

Those skilled in the art will appreciate that the fin assembly and fin box assembly may have any suitable dimensions.

Illustrative dimensions for the fin assembly and fin box assembly are shown in FIGS. 6, 7 and 8, where D1 is between about 2 and about 48 inches, D2 is between about 0.25 and about 3 inches, D3 is between about 2 and about 48 inches, D4 is between about 0.5 and about 24 inches, D5 is between about 0.5 and about 12 inches, D6 is between about 1 and about 24 inches, D7 is between about 0.125 and about 2 inches, D8 is between about 0.4 and about 12 inches, D9 is between about 0.125 and about 4 inches, D10 is between about 2 and about 48 inches, D11 is between about 0.1 and about 3 inches, and D12 is between about 0.1 and about 3 inches. It should be kept in mind that these ranges are presented by way of example only, and higher or lower values may be used for any of the dimensions in various embodiments.

Figure 11:
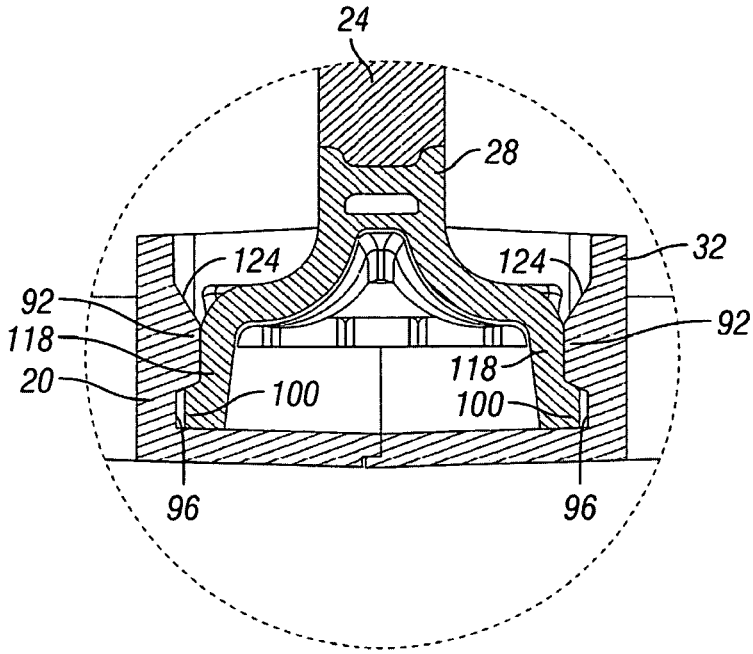
FIG. 11 is an enlarged detail view of portion B of FIG. 10.

As is best seen in FIGS. 7 and 11, the base member 28 also includes a laterally projecting flange member 100 that is formed for engagement within the undercut 96 formed within the fin box 32. This engagement creates a coupling between the fin assembly 24 and the fin box assembly 20.

FIG. 7 provides a cross-sectional view of both the fin box 32 and the base member 28. It can be seen that the base member is formed with downwardly projecting leg portions 118 that include the outwardly projecting flange members 100. The fin box includes the inwardly projecting ridges 92 that form undercuts 96 along the lower inner surface of the side walls of the fin box, such that the outwardly projecting flange members 100 of the legs 118 will become engaged in the undercuts when the base member 28 is inserted in the fin box 32. A detailed depiction and description of the engagement of the base within the fin box is presented herebelow with regard to FIGS. 9, 10 and 11. Regarding FIG. 8, it can be seen that the slots 110 that are formed in the base member are disposed to receive the support ridges 80 that are formed in the fin box, and the rearward portion 120 of the fin box.

Figure 10:
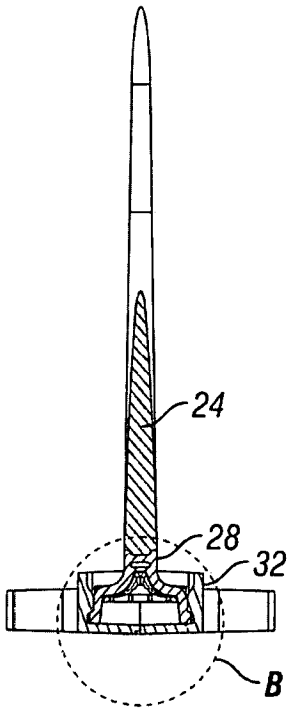
FIG. 10 is a cross-sectional view taken along lines A-A of FIG. 9.
Figure 9:
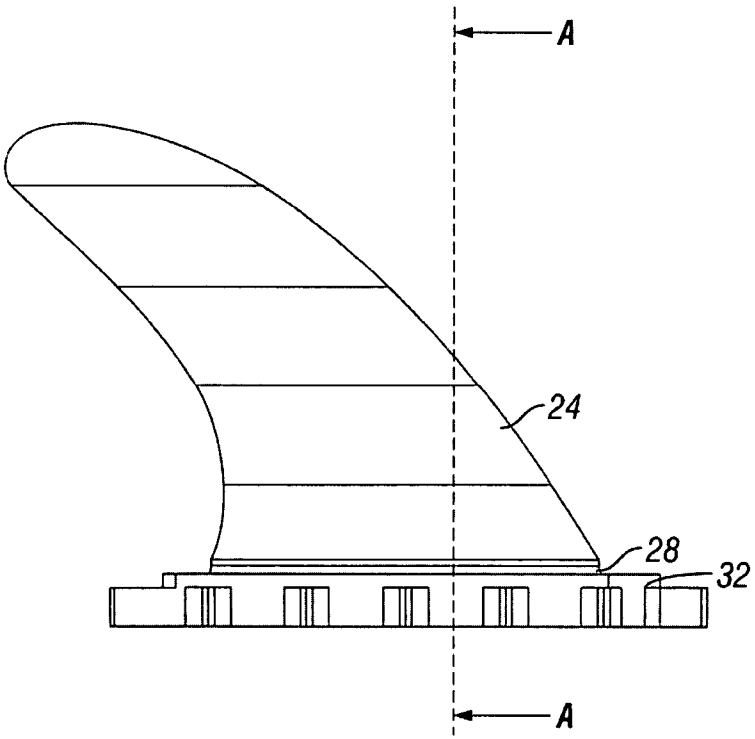
FIG. 9 is a side elevational view of an assembled fin device according to one embodiment of the present invention.

Depictions of the assembled fin 10 according to one embodiment of the present invention are presented in FIGS. 9, 10 and 11, wherein FIG. 9 is a side elevational view, FIG. 10 is a cross-sectional view taken along lines A-A of FIG. 9, and FIG. 11 is an expanded view of the detail section B of FIG. 10. As depicted in FIGS. 9, 10 and 11, the base member 28 is formed to be releasably engaged in the fin box 32. With particular reference to FIG. 11, it can be seen that the inwardly projecting ridges 92 of the sides of the fin box form the undercuts 96. The outwardly projecting flange members 100 of the leg portions 118 of the base member 28 are sized to become disposed within the undercuts 96. The inwardly projecting ridges 92 are preferably formed with a sloped inwardly projecting upper surface 124, such that the leg portions 118 of the base member 28 are pinched inwardly when the base member is being inserted in the fin box.

The base member 28 may be formed of a resiliently elastic material that allows it to deform without breaking when inserted into the fin box 32. Such material preferably allows the leg portions 118 of the base member 28 to be pinched inwardly without breaking as the base member 28 is inserted within the fin box 32. Additionally, the resilient nature of the base member material may be such that the outwardly projecting flange members 100 are urged into the undercuts 96 when the base member is fully inserted in the fin box, and preferably exert a force against the ridges 92 and/or undercuts 96 when inserted in the fin box 32. Suitable materials from which to form the base member 28 include plastics, resins, etc. The base member in one approach is composed of a resiliently elastic material, such as ULTEM, a polyetherimide polymer from General Electric Company (ULTEM is a registered trademark of General Electric Company).

In another embodiment, the base member may include leg portions 118 that have no slots 110. In one approach, the base member may have two leg members, each with a continuous bottom edge. In another embodiment, the base member may have leg portions 118 with something other than a flange 100. For example, the leg portions may have bulbous protrusions that form a ball-in-socket coupling rather than a tongue in groove arrangement as shown in FIG. 11. In further embodiments, the leg portions may have depressions that receive protrusions of the fin box for effecting the coupling of the base member to the fin box. In yet other embodiments, members may extend between the leg portions on opposite sides of the base member.

It is therefore to be understood that the base member is preferably formed to be releasably engagable in the fin box. Accordingly, in one approach, the fin box can be permanently molded into a surfboard or the like, and various different types and styles of fin assemblies can be selected by a user for interchangeable insertion into the fin box. Alternatively, where a fin member is releasably engagable with the base member, a user may selectively couple different fin members to the base member and insert a base member in the fin box.

In use, with reference to FIG. 11, to insert the fin assembly into the fin box 32, the base member 28 may be inserted into the fin box, and pressure exerted thereupon to cause the leg portions 118 to deform slightly as they pass over the ridges 92 and the flange members 100 snap into the undercuts 96. As noted above, the inwardly projecting ridges 92 may be formed with a sloped inwardly projecting upper surface 124, such that the leg portions 118 of the base member 28 are pinched inwardly when the base member is being inserted in the fin box.

Figure 12:
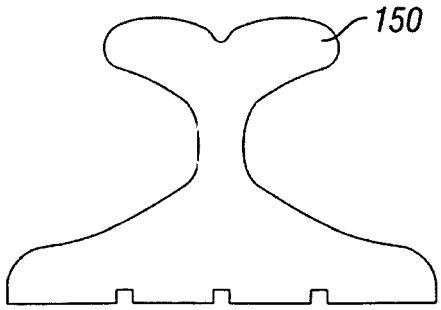
FIG. 12 is a side view of a key that may be used to assist in inserting a fin assembly into a fin box assembly.

Assistive devices may be employed to facilitate coupling of the fin assembly with the fin box. FIG. 12 is a side view of a key 150 that may be used to assist in inserting the fin into the base member. In use, with reference to FIGS. 8, 11 and 12, the key 150 is used to bias one row of the leg portions 118 towards the other row, thereby facilitating assembly. As shown, the key may include slots 152 corresponding to the slots 110 of the base member 28 and/or the support ridges 80 that are formed in the fin box 32.

To remove the fin assembly from the fin box, a force sufficient to overcome the coupling engagement of the base member and the fin box may be exerted on the fin assembly. Alternatively, an assistive device such as the aforementioned key may be used.

Further, as is apparent from the foregoing description, the fin assembly may be adapted to be removed from the fin box unintentionally, e.g., due to striking or engaging an underwater obstacle such as a reef, rock, another surfboard, etc. In this way, the fin assembly becomes decoupled from the surfboard or the like without damaging the structure of the surfboard or the like. The aforementioned tether, if present, prevents loss of the fin assembly.

Finally, it is to be understood that various embodiments of the fin and/or various component parts thereof singularly or in any combination may be employed with any type of waterborne device, including motorized and nonmotorized devices. Examples of the former include boats, personal watercraft, etc. Examples of the latter include surfboards, sailboard, water skis, etc.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

We claim:

1. A fin, comprising:

a fin box assembly including a fin box adapted for coupling to a body portion of a water-borne device; and a fin assembly having a base member that is releasably engagable in said fin box and a fin member coupled to said base member, wherein said base member is not slidable in a direction parallel to a longitudinal axis of the fin box when engaged in said fin box, and wherein said base member includes outwardly-extending protrusions that engage a depression extending along two sides of an internal periphery of said fin box.

2. The fin as recited in claim 1, wherein said fin member is fixedly coupled to said base member.

3. The fin as recited in claim 1, wherein said fin member is detachably coupled to said base member.

4. The fin as recited in claim 2, wherein the depression in the fin box is an undercut slot defined in part by an inwardly projecting ridge extending inwardly from the internal periphery of the fin box, wherein the outwardly-extending protrusions of the base member are flanges that engage the ridge of the fin box when the fin assembly is coupled to the base member.

5. The fin as recited in claim 1, wherein the base member includes flange members that engage a groove in the fin box.

6. The fin as recited in claim 1, wherein the base member includes multiple leg portions defined in part by slots positioned therebetween, the leg portions engaging the fin box.

7. The fin as recited in claim 1, wherein the fin box includes ribs extending outwardly therefrom.

8. The fin as recited in claim 1, wherein the fin box assembly includes a base, the fin box being coupled to the base.

9. The fin as recited in claim 1, wherein the fin assembly includes a tether engagement portion.

10. The fin as recited in claim 9, wherein the fin box includes a second tether engagement portion.

11. A surfboard having the fin of claim 1.

12. A sailboard having the fin of claim 1.

13. A tin assembly, comprising:

a base member adapted for releasable engagement in a fin box that is coupled to a water-borne device; and a fin member coupled to said base member, wherein said base member is not slidable in a direction parallel to a longitudinal axis of the fin box when engaged in said fin box, and wherein said base member includes outwardly-extending protrusions that engage a depression extending along two sides of an internal periphery of said fin box.

14. The fin as recited in claim 13, wherein the fin member is fixedly coupled to said base member.

15. The fin as recited in claim 13, wherein the fin member is detachably coupled to said base member.

* * * * *